US007637376B2

(12) United States Patent
Silva et al.

(10) Patent No.: US 7,637,376 B2
(45) Date of Patent: Dec. 29, 2009

(54) BILLIARD ACCESSORY CASES, BILLIARD ACCESSORY STORAGE, TRANSPORTATION AND DISPLAY METHODS

(76) Inventors: Timothy Joel Silva, 1517 N. 7th St., Coeur d'Alene, ID (US) 83814; Christian Dewitt Walsh, 906 W. Ohio Match Rd., Rathdrum, ID (US) 83858

( * ) Notice: Subject to any disclaimer, the term of this patent is extended or adjusted under 35 U.S.C. 154(b) by 329 days.

(21) Appl. No.: 11/881,261

(22) Filed: Jul. 26, 2007

(65) Prior Publication Data

US 2008/0083680 A1 Apr. 10, 2008

Related U.S. Application Data

(60) Provisional application No. 60/850,397, filed on Oct. 10, 2006.

(51) Int. Cl.
*B65D 69/00* (2006.01)

(52) U.S. Cl. ..... 206/579; 206/45.24; 206/315.1

(58) Field of Classification Search ..... 206/45.2, 206/45.21–45.24, 315.1, 315.7, 443, 579, 206/759, 762, 766, 774; 211/68; 220/23.86, 220/23.87, 23.88, 521, 522, 528, 557; 473/1, 473/44

See application file for complete search history.

(56) References Cited

U.S. PATENT DOCUMENTS

| | | | | |
|---|---|---|---|---|
| 1,879,029 | A * | 9/1932 | Baumgard | 206/45.23 |
| 4,898,352 | A * | 2/1990 | Hoffman | 206/315.7 |
| 5,248,030 | A * | 9/1993 | Tarozzi | 206/45.23 |
| 5,924,662 | A | 7/1999 | Monty | |
| 6,364,100 | B1 * | 4/2002 | Leibeck | 206/45.23 |
| 2006/0196791 | A1 * | 9/2006 | Evans et al. | 206/315.1 |
| 2007/0158509 | A1 * | 7/2007 | Hubbell | 206/315.7 |

* cited by examiner

*Primary Examiner*—Luan K Bui
(74) *Attorney, Agent, or Firm*—Wells St. John P.S.

(57) ABSTRACT

Pool cue storage, display and transportation processes are provided which can include supporting a pool cue case in an upright longitudinal position with a member extendable from within the case. Pool cue cases are provided that may define a pool cue compartment having a member movably associated with the case, with the member configured to support the case when the case is in an open position.

6 Claims, 12 Drawing Sheets

BILLIARD ACCESSORY CASES, BILLIARD ACCESSORY STORAGE, TRANSPORTATION AND DISPLAY METHODS

CLAIM FOR PRIORITY

This application claims priority to U.S. Provisional Patent Application, Ser. No. 60/850,397 entitled "Qcaddy" filed Oct. 10, 2006, the entirety of which is incorporated by reference herein.

TECHNICAL FIELD

The present disclosure relates generally to cases and display cases, and more particularly to billiard accessory cases, billiard accessory storage, transportation and display methods.

BACKGROUND OF THE DISCLOSURE

As billiard play has grown in popularity, it has become more and more important for individual billiard players to have their own pool cues, for example, customized pool cues. These pool cues typically are constructed in two parts, having a front half or cue half, and a rear half or handle half. The halves are configured to be joined in the middle, providing a solid and balanced cue for the playing of billiards. To facilitate the handling of these delicate and/or custom crafted pieces of equipment, cases have been utilized. Cases typically include only one compartment that is felt lined to house the pool cue itself.

As tournament play of billiards has become more and more popular, it has become increasingly important for players to have more than one pool cue available during tournament play for different shots, for example, or if one pool cue becomes out of balance or becomes damaged. During tournament play, likewise, racks for supporting cues may not be available, so players can be observed leaning them against chairs or against side railings, and because they are round in construction, they can easily slide off and become damaged as they fall. The present disclosure provides pool cue cases for storage, display, and/or transportation of pool cues as well as methods for storage, display, and/or transportation of pool cues and accessories.

DESCRIPTION OF THE DRAWINGS

Preferred embodiments of the invention are described below with reference to the following accompanying drawings.

DESCRIPTION

This disclosure is submitted in furtherance of the constitutional purposes of the U.S. Patent Laws "to promote the progress of science and useful arts" (Article 1, Section 8).

Figure 1:
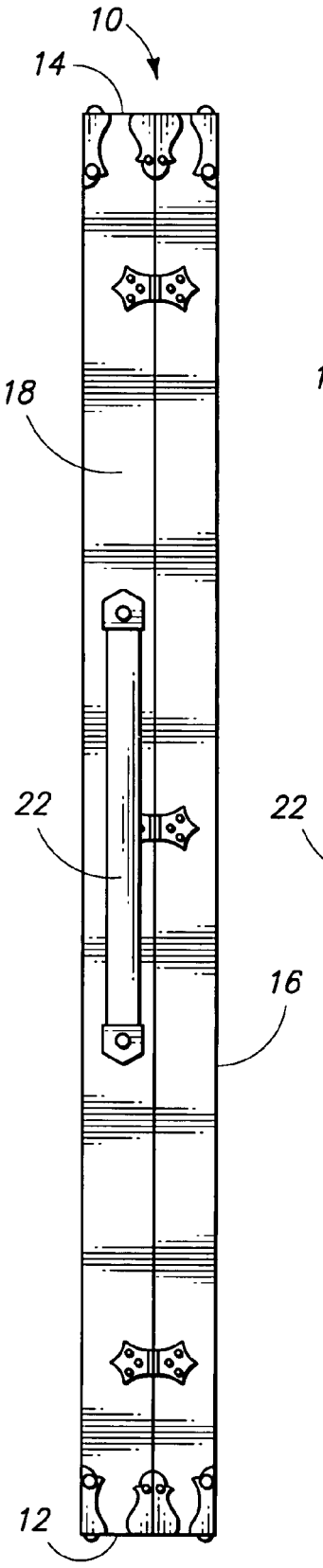
FIG. 1 is a view of a pool cue case according to an embodiment.
Figure 2:
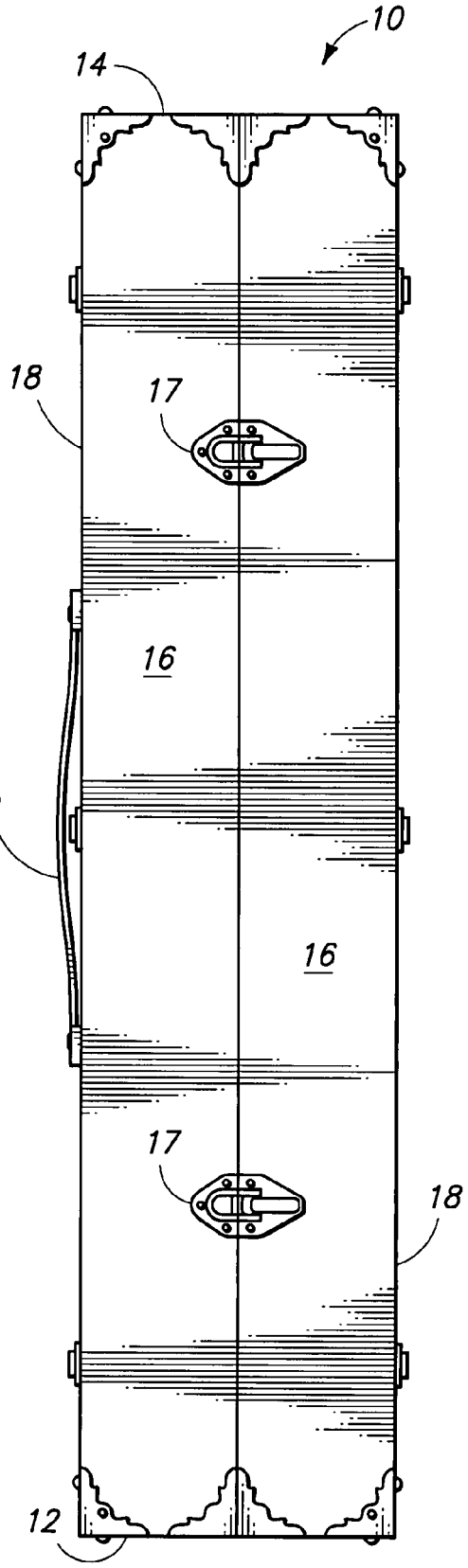
FIG. 2 is another view of the pool cue case of FIG. 1 according to an embodiment.
Figure 3:
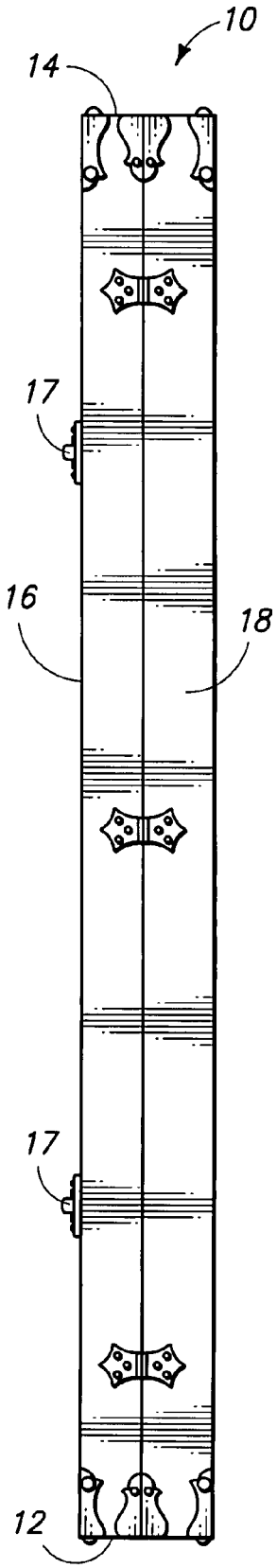
FIG. 3 is another view of the pool cue case of FIG. 1 according to an embodiment.

Pool cue cases and methods of storing and/or displaying pool cues are described with reference to FIGS. 1-18. The cases can be constructed of wood, metal, combinations of wood with metal hinges and/or brackets, as well as carbon fiber, plastic, and/or plastic composites. Referring to FIGS. 1-3, views of a pool cue case 10 are provided with pool cue case 10 having a first end 12 and second end 14, with these ends being the distal ends of case 10. In typical pool cue case configurations, these are the lengthwise ends of the pool cue case. Typical pool cue cases are designed to house sections of pool cues, as pool cues are typically broken down in halves. These sections can be anywhere from two to four feet in length, typically about three feet in length. Pool cue case 10 can have a front or door 16 with a clasp 17 as well as sides 18 and opposing side 20 with opposing side 20 having handle 22, for example.

Figure 4:
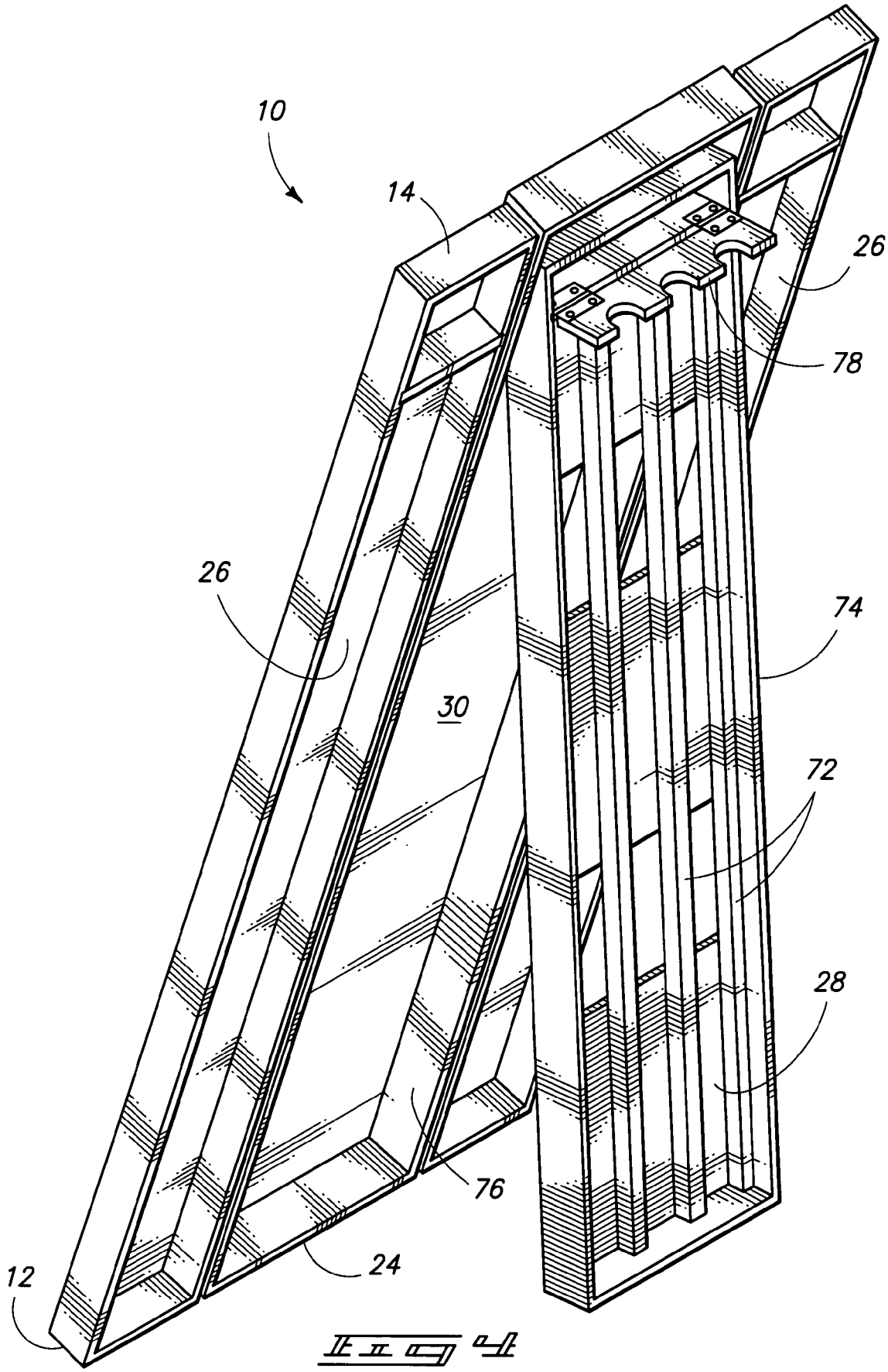
FIG. 4 is a view of the pool cue case of FIG. 1 according to an embodiment.

Referring to FIG. 4, case 10 can have multiple compartments. Case 10 may have compartment 24, compartments 26 and/or compartment 28. According to exemplary configurations, compartment 28 can be a member movably associated with case 10, for example, movably coupled to case 10. Compartment 28 can be movably associated with case 10 by being configured to be removed from case 10 and support case 10 via engaging a portion of compartment 24, for example. In the shown embodiment, the member can be movably coupled within case 10 and/or within a compartment, such as compartment 24, for example. Case 10 can define at least one compartment; as shown, for example, case 10 can define at least four compartments. Compartment 28 can have a length at least as long as half of a pool cue, or may have a length less than the length of compartment 24, for example. Compartment 28 may be coupled within another compartment, such as compartment 24 shown, and/or compartment 26 can define the lid to case 10.

Figure 5:
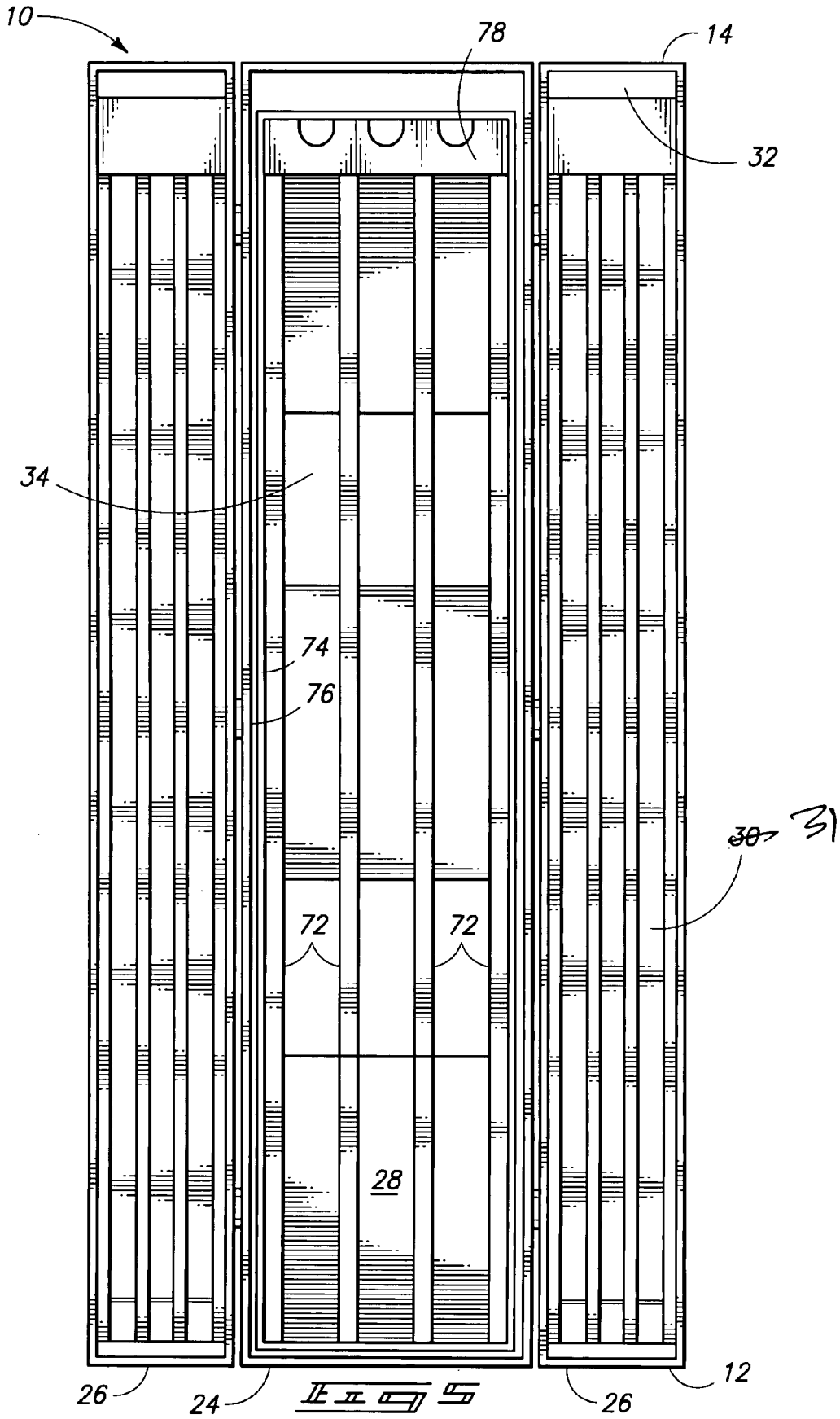
FIG. 5 is a view of the pool cue case of FIG. 1 according to an embodiment.

Referring to FIG. 5, case 10 can be configured to house multiple pool cues. For example, compartments of case 10 may be configured to house the distal ends or cue tip ends of the pool cues in sections 31 while housing the butt or handle ends of pool cues in sections 34. Furthermore, case 10 may be configured to house pool cue accessories such as chalk in compartments 32.

Figure 6:
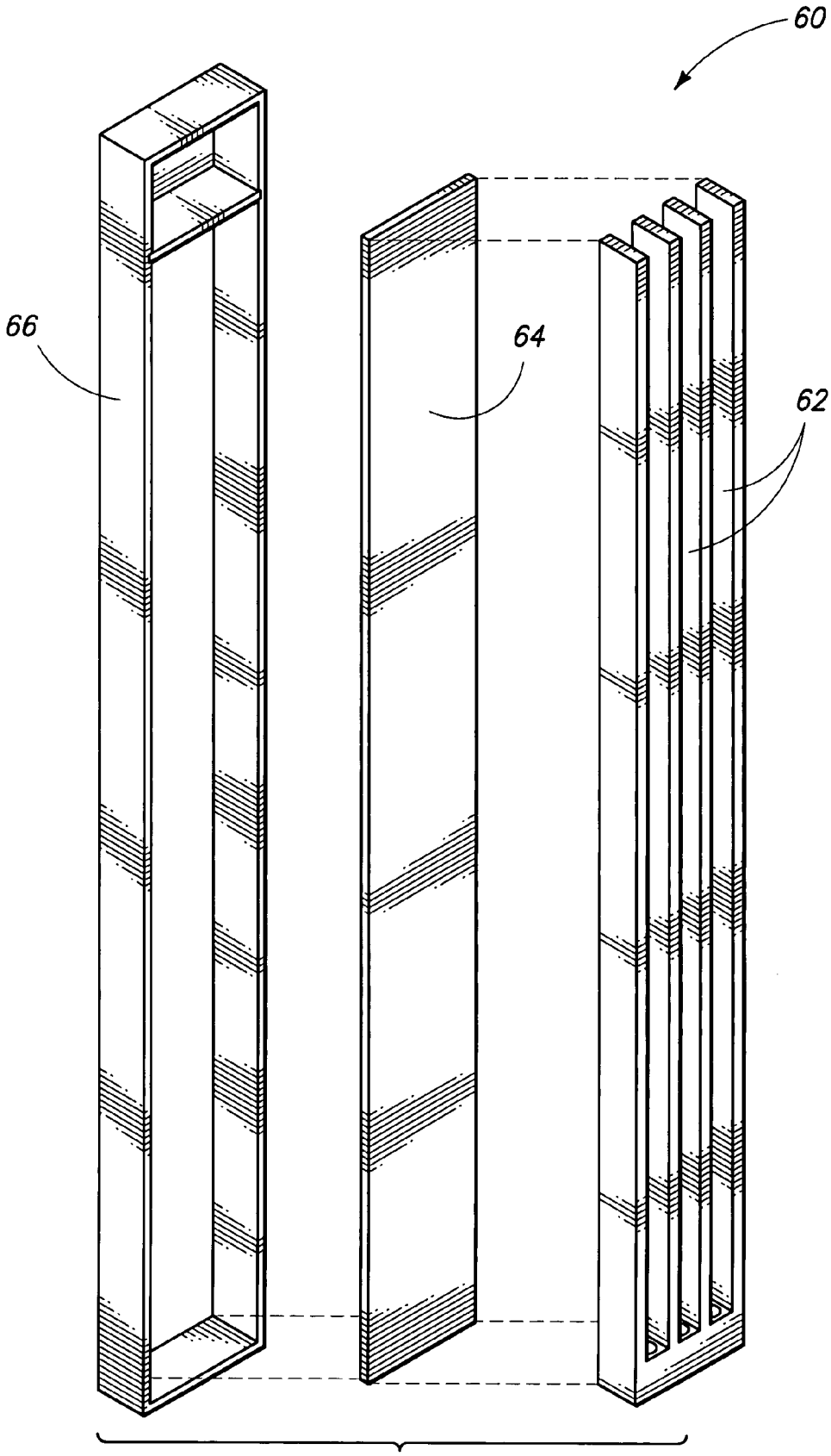
FIG. 6 is a view of a compartment of a pool cue case according to an embodiment.

Referring to FIG. 6, in an exemplary embodiment, cases and/or compartments of cases may be constructed of wood and/or metal materials, depending on the decorative needs of the user. For example, a compartment may be constructed of three components; divider 62 having backing 64 placed within frame 66 may be utilized to produce a compartment of pool cue case 10, for example.

Figure 7:
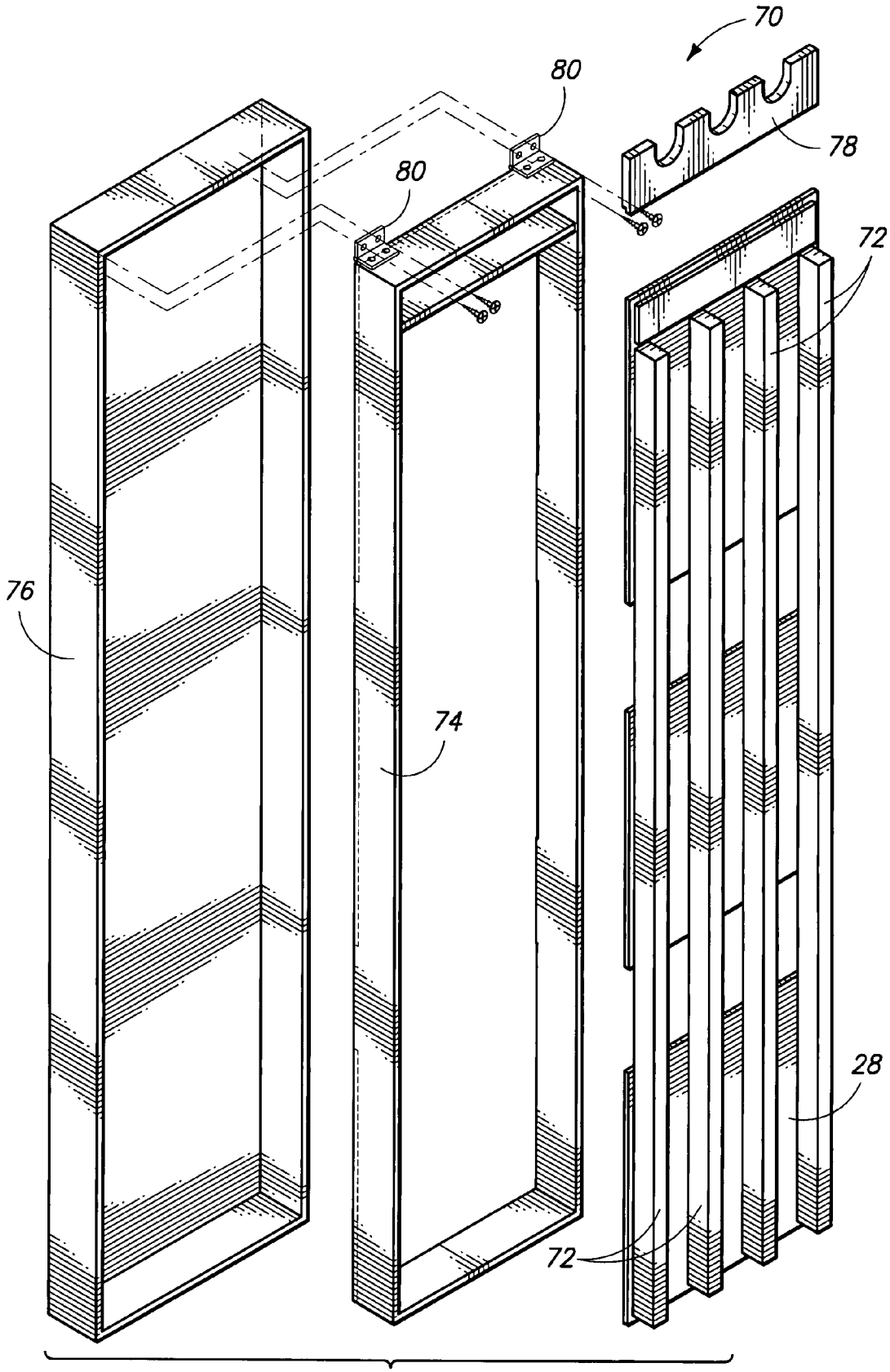
FIG. 7 is a view of a compartment of a pool cue case according to an embodiment.
Figure 8:
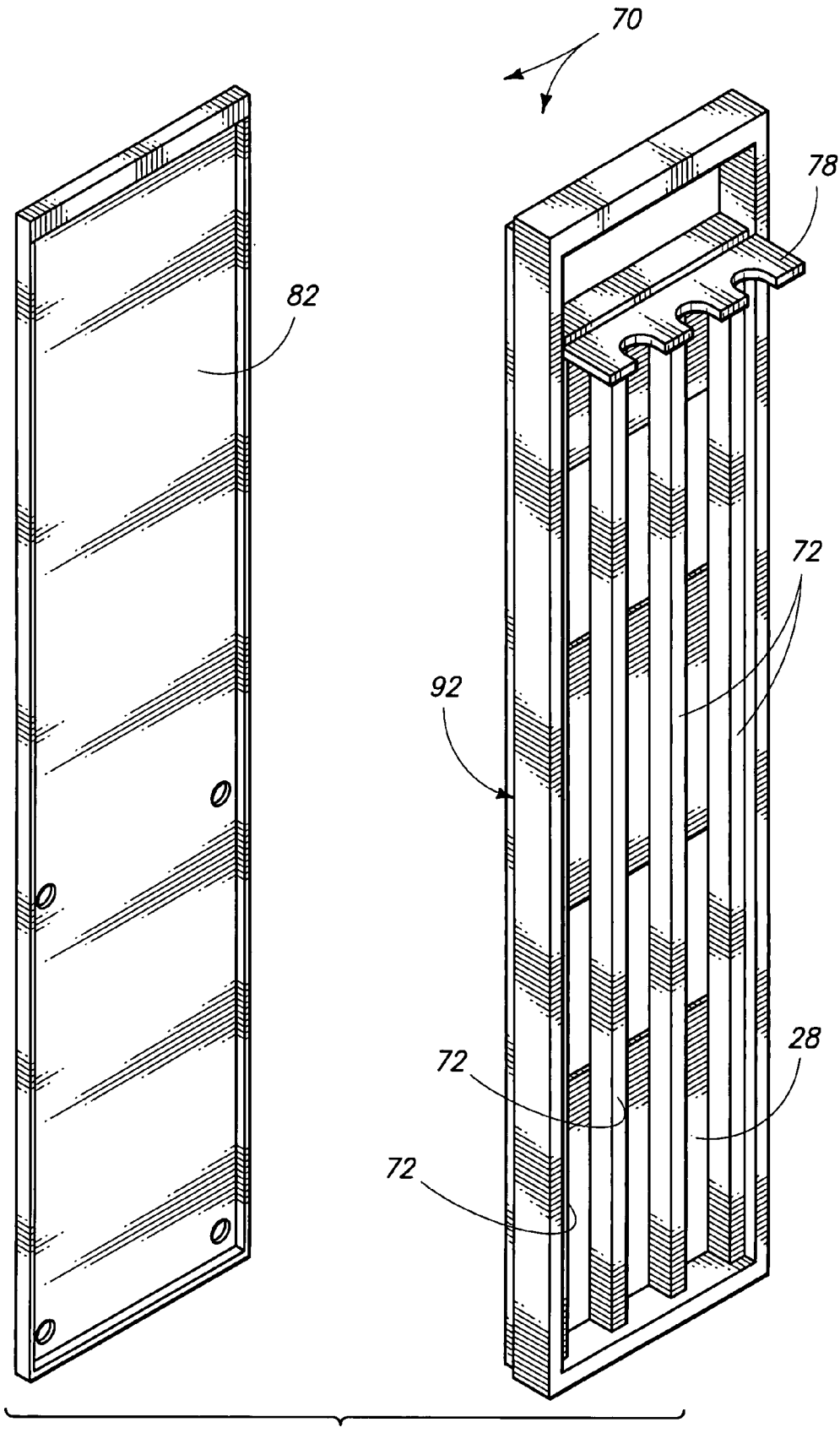
FIG. 8 is a view of the compartment of FIG. 7 according to an embodiment.

As another example, referring to FIG. 7, a compartment 70 may be constructed of dividers 72 placed within a frame 74 and frame 74 placed within another compartment 76. As is shown, frame 74 may include coupling mechanisms 80 to facilitate the coupling of compartment 70 within a compartment of case 10 such as compartment 76. These coupling mechanisms can be hinges, for example. Furthermore, this particular compartment may include a flange 78. Flange 78 may be coupled to compartment 74, for example, at a point above divider 72. Flange 78 may be utilized as a support to support pool cues in a display position when the pool cue case is in an upright and open and display position. Referring to FIG. 8, component 70 is shown with flange 78 in the open position, and a backing 82 for placement of a compartment against backing 82.

Figure 9:
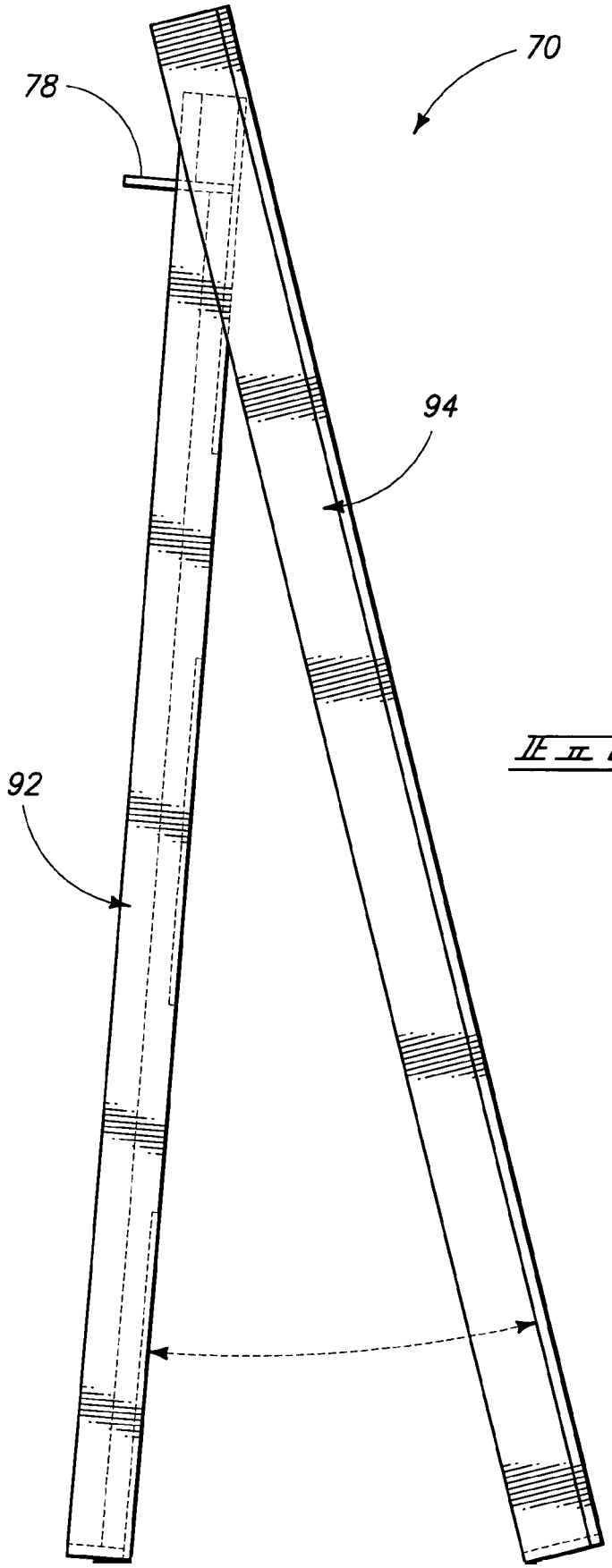
FIG. 9 is a view of the case of FIG. 1 according to an embodiment.
Figure 10:
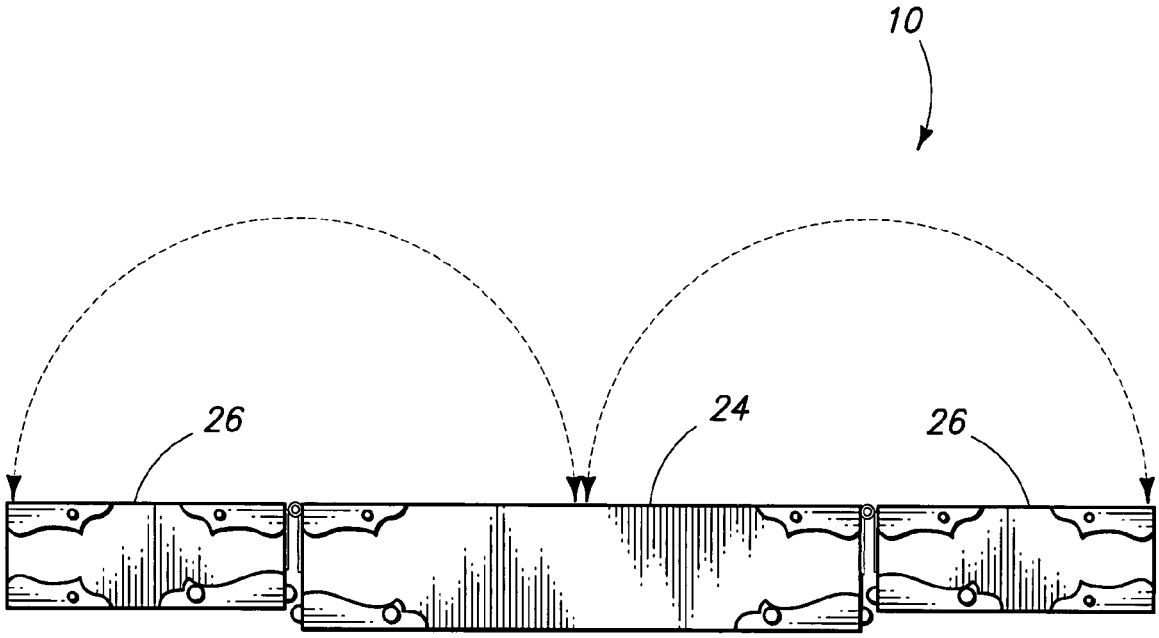
FIG. 10 is a view of the case of FIG. 1 according to an embodiment.

Referring to FIG. 9, component 70 is shown in its open position or second position, as opposed to its storage position or first position. Compartment 92 is shown in a display position to support the remainder of case 10 and compartment 94 for example. Compartment 92 may be folded within or enclosed within compartment 94 during storage of pool cues and/or transportation of pool cues, for example. In the shown position, flange 98 is extended to facilitate the display of pool cues. Referring to FIG. 10, case 10 is shown in an open position with compartments 26 open to compartment 24.

Figure 11:
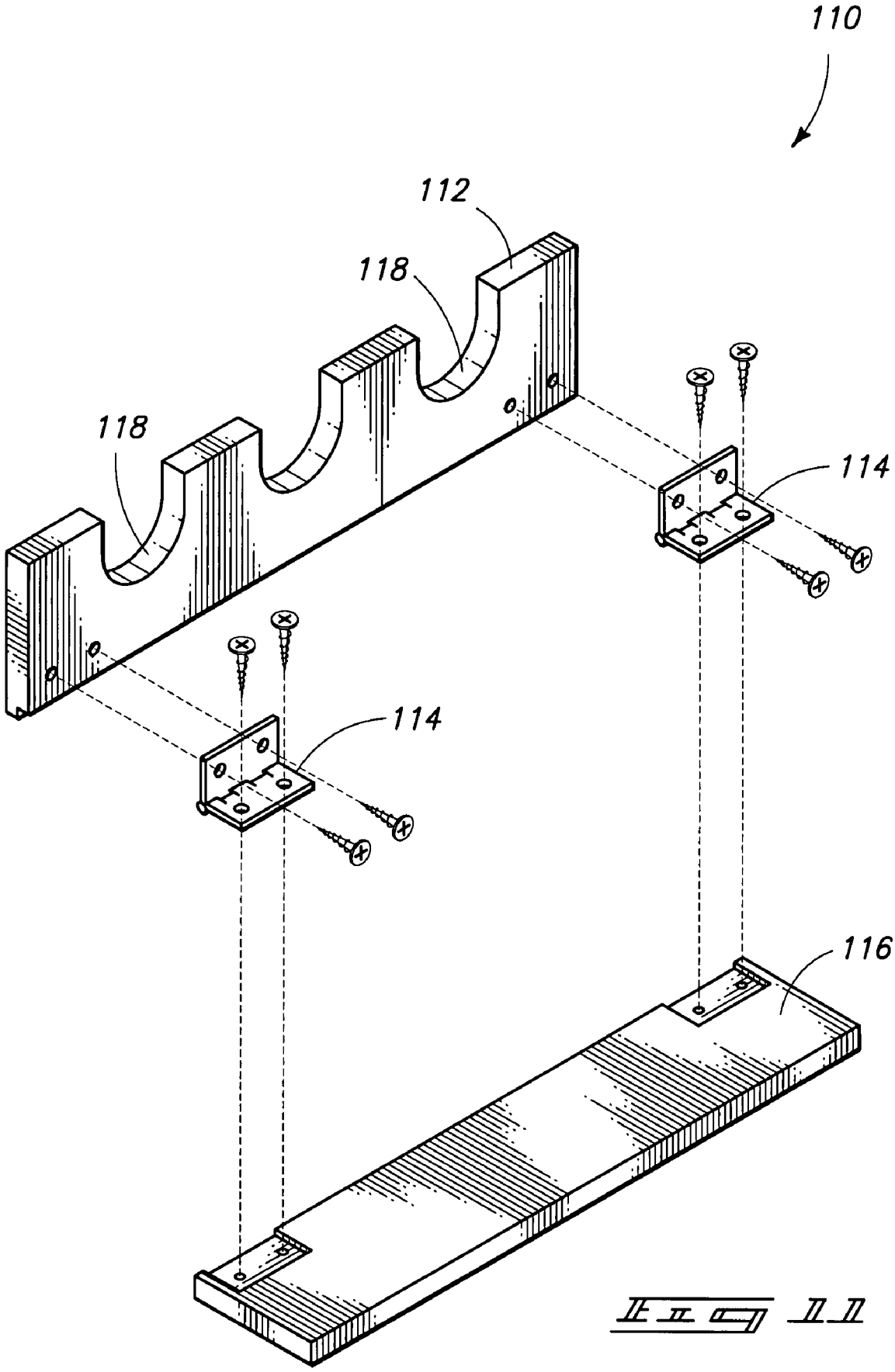
FIG. 11 is a component of a pool cue case according to an embodiment.
Figure 12:
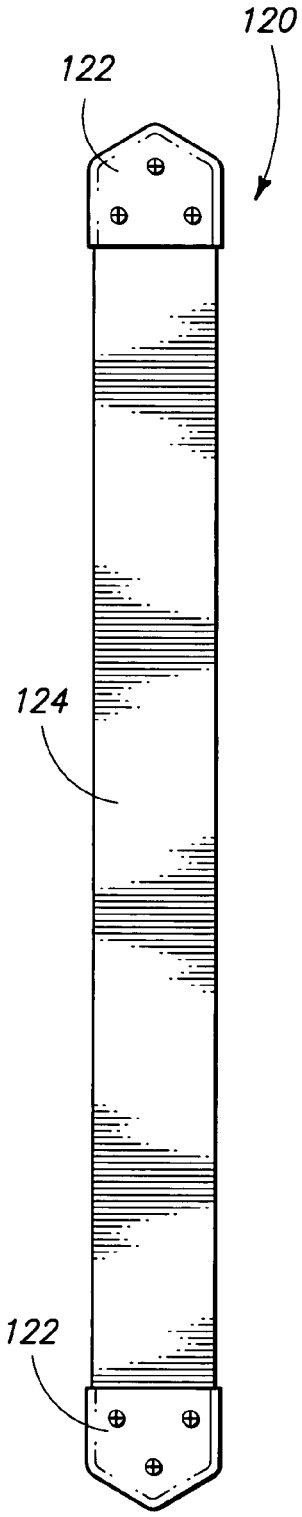
FIGS. 12 and 13 are components of a pool cue case according to an embodiment.

Referring to FIG. 11, component 110 is an example embodiment of a flange assembly. Flange assembly 110 can include flange 112 coupled to backing 116 utilizing coupling devices 114. Exemplary coupling devices 114 can include hinges, for example. Flange 112 can include openings 118 configured to receive a pool cue, for example.

Figure 13:
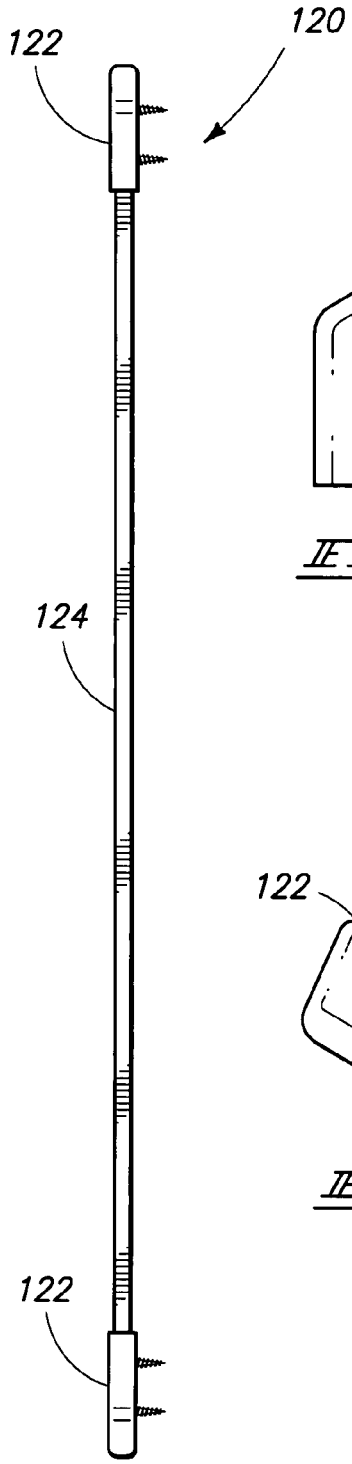
Figure 14:
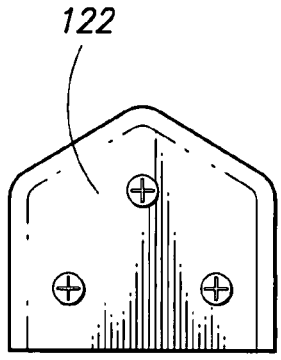
FIGS. 14-16 are components of a pool cue case according to an embodiment.
Figure 15:
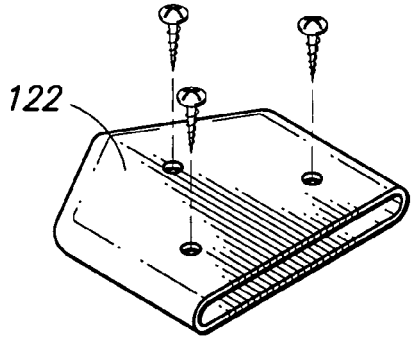
Figure 16:
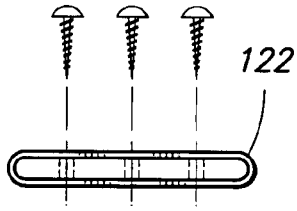

Referring to FIGS. 12-16, example handle 120 is shown that includes handle coupling devices 122 and handle 124. Handle 124 can be a leather handle, for example, and coupling devices 122 can be leather strap mounts, for example. These strap mounts can be coupled to case 10, for example, utilizing screws. FIG. 13 is an exemplary side view of handle 120, and FIGS. 14-16 are example views of coupling mounts 122.

Figure 17:
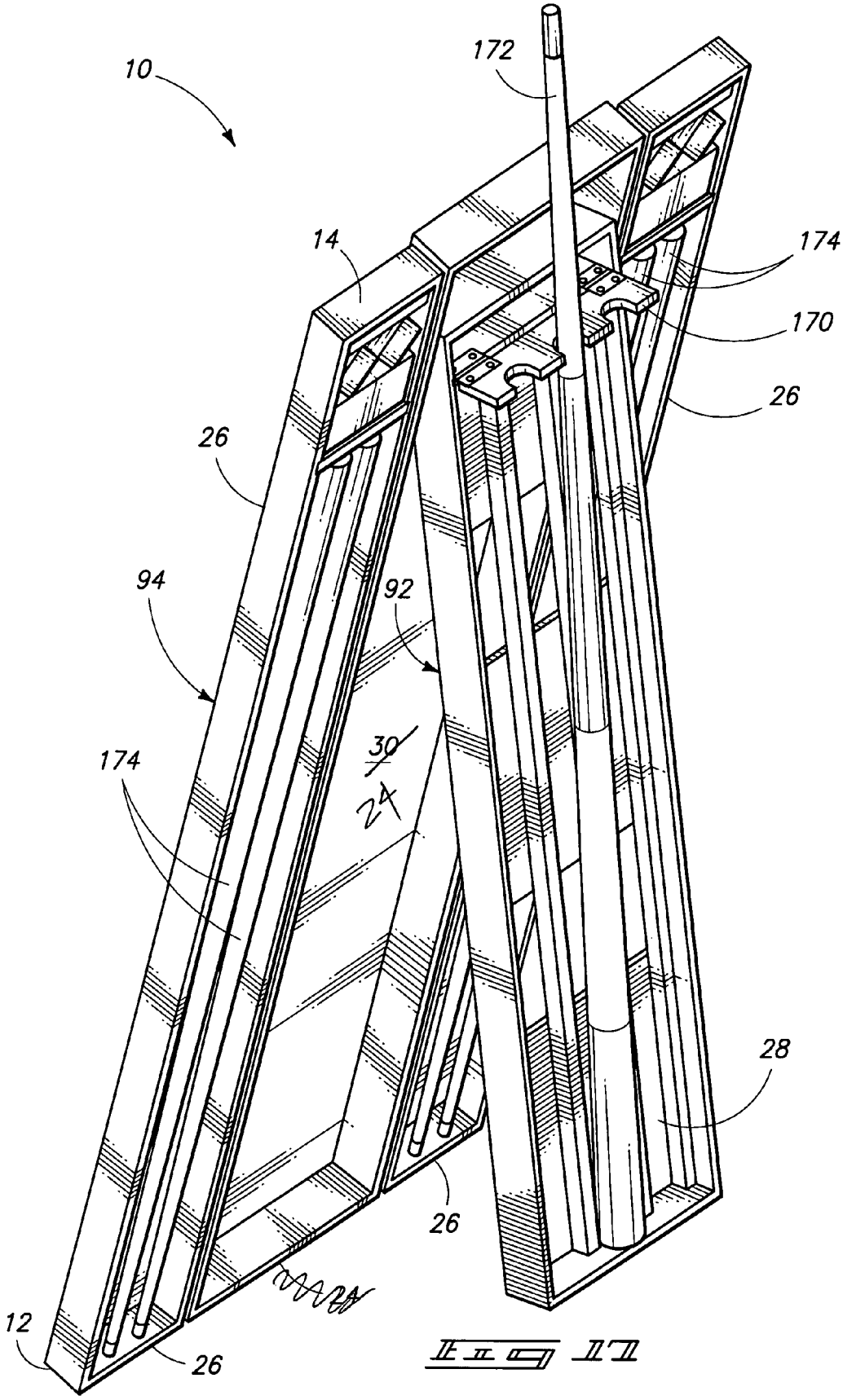
FIG. 17 is the pool cue case of FIG. 1 according to an embodiment.
Figure 18:
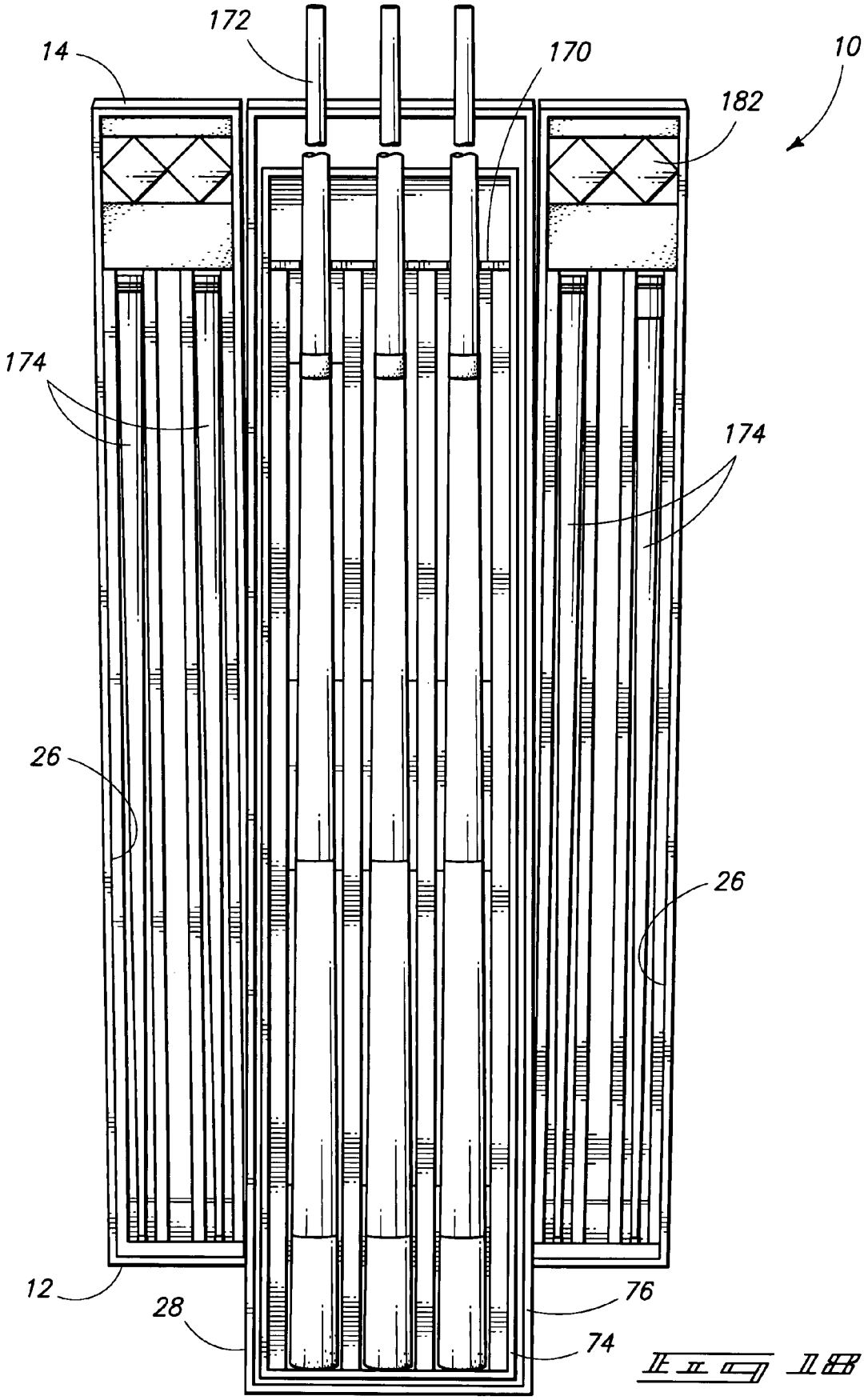
FIG. 18 is the pool cue case of FIG. 1 according to an embodiment.

Referring to FIG. 17, case 10 is shown in its open or display position with compartment 28 extended from compartment 24 at an angle other than normal to support case 10 in the display position. Flange 170 is shown in the open position to support pool cue 172. As can be shown, additional pool cues 174 are shown housed in compartments 26, for example. Referring to FIG. 18 a front view of case 10 is shown storing additional billiard accessories such as pool chalk 182 within case 10.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

The invention claimed is:

1. A pool cue case defining a pool cue compartment, the case comprising: a member connected and extendable from within the case, the member configured to support the case in an upright position when the case is in an open position; at least one compartment defined by the member; and a flange movably coupled to the at least one compartment, wherein the flange defines openings configured to support pool cues.

2. The case of claim 1 having a length of at least half of a standard pool cue.

3. The case of claim 1 wherein the member is movable to extend from the case at an angle other than normal.

4. The case of claim 1 wherein a door of the case is comprised by a compartment, the compartment configured to house a portion of a pool cue.

5. The case of claim 1 wherein a door of the case is comprised by a compartment, the compartment configured to house a portion of a billiard accessory.

6. The case of claim 5 wherein the billiard accessory is pool chalk.

* * * * *